United States Patent [19]

Wilkinson

[11] Patent Number: 5,003,910

[45] Date of Patent: Apr. 2, 1991

[54] ANCHOR

[75] Inventor: Bruce S. Wilkinson, Gloucester, Mass.

[73] Assignee: Rule Industries, Inc., Burlington, Mass.

[21] Appl. No.: 405,542

[22] Filed: Sep. 11, 1989

[51] Int. Cl.[5] ..... B63B 21/44

[52] U.S. Cl. ..... 114/304; 114/309

[58] Field of Search ..... 114/304, 309; 52/162; 29/DIG. 3

[56] References Cited

U.S. PATENT DOCUMENTS

| | | | |
|---|---|---|---|
| 2,249,546 | 7/1941 | Danforth | 114/208 |
| 2,282,566 | 5/1942 | Danforth | 114/208 |
| 2,354,666 | 4/1944 | Danforth | 114/208 |
| 2,641,215 | 6/1953 | Danforth | 114/208 |
| 2,643,631 | 6/1953 | Danforth | 114/208 |
| 3,030,906 | 4/1962 | Danforth | 114/208 |
| 3,190,252 | 6/1965 | Keepers | 114/309 |
| 3,529,563 | 9/1970 | Fast | 114/309 |
| 3,858,543 | 1/1975 | Hungerford | 114/208 |
| 3,902,446 | 9/1975 | van den Haak | 114/208 |
| 3,964,420 | 6/1976 | Stelling | 114/208 |
| 4,261,281 | 4/1981 | Petersen | 114/304 |
| 4,394,842 | 7/1983 | van den Haak | 114/304 |
| 4,397,256 | 8/1983 | Bruce | 114/303 |
| 4,409,923 | 10/1983 | MacPherson | 114/304 |

OTHER PUBLICATIONS

*Cruising World,* May, 1989 (reprint).

*Primary Examiner*—Sherman D. Basinger
*Attorney, Agent, or Firm*—Fish & Richardson

[57] ABSTRACT

A twin-fluke anchor has a shank, a stock, fluke elements mounted upon the stock to pivot as a unit at the inner end of the shank, each element including a fluke surface in a first plane and a rib generally perpendicular to the first plane, the shank disposed between ribs, and a crown including a pair of flat plates having opposed inner surfaces, each plate supported centrally of the flukes and spaced from the flukes plane and sloping upwardly and rearwardly away from the plane to permit bottom material to flow freely between the inner surfaces of the plates and the flukes. The shank inner end has opposite end surfaces to engage upon respective opposed inner surfaces of the crown plates to limit the range of pivoting movement of flukes, at least one end surface of the shank engaging an opposed inner surface of a crown plate along a line of contact whereby holding load is transferred from the shank to the flukes by a long coupled reaction. Also, each fluke element further includes an integral bracket extension and the crown plates are mounted upon the integral extensions.

3 Claims, 4 Drawing Sheets

FIG. 1
PRIOR ART
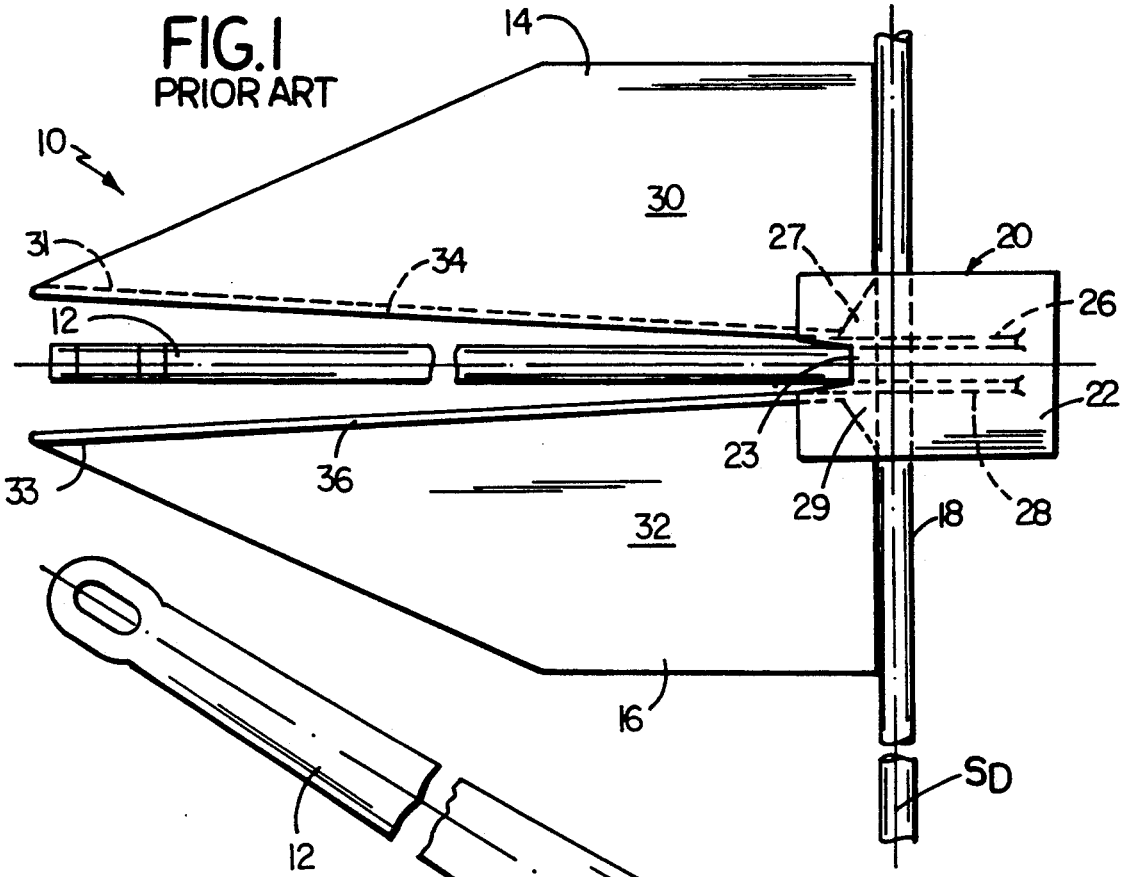
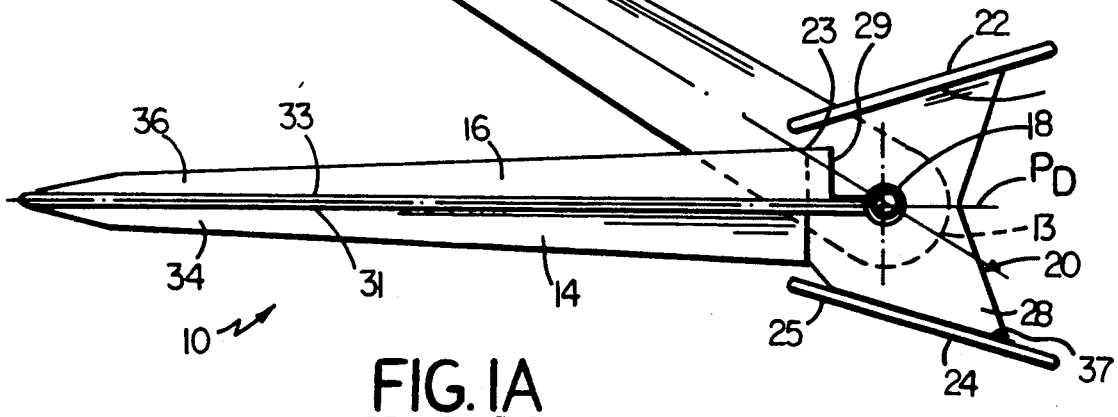
FIG. 1A
PRIOR ART

ANCHOR

BACKGROUND OF THE INVENTION

The invention relates to lightweight anchors.

A twin fluke anchor, e.g. the Danforth Standard Anchor as manufactured by Rule Industries, Inc. of Burlington and Gloucester, Mass. and shown in Danforth U.S. Pat. No. 2,643,631, includes a shank disposed between twin flukes, which are secured together as a unit to pivot at one end of the shank, and a crown constructed of plates disposed on both sides of the fluke pivot, each plate sloping upwardly and toward the rear of the anchor from the plane of the flukes at a relatively acute angle. The Danforth anchor design, developed during World War II, is the most frequently used type of anchor in service on commercial and pleasure boats today.

When a twin fluke anchor is cast overboard from a boat and permitted to fall upon bottom, both flukes engage the ground simultaneously. The crown structure ensures that the flukes engage bottom positively and without too much loss of time. A relatively high degree of holding power is developed by the large surface areas of the flukes which tend to bury in homogeneous bottom conditions, due to the nature of the design.

SUMMARY OF THE INVENTION

The invention is directed to twin-fluke anchors comprising a shank with a first end and a second end, a stock, a pair of flukes mounted upon the stock in a manner to pivot as a unit at the second end of the shank, each fluke defining a fluke surface disposed in a first plane, and a rib disposed generally perpendicular to the first plane, the shank disposed between the ribs, and a crown comprising a pair of substantially flat crown plates having opposed inner surfaces, each crown plate being supported centrally of the flukes in a position wherein the crown plate is spaced from the first plane of the flukes, each crown plate sloping upwardly and rearwardly away from the first plane of the flukes in a manner to permit bottom material to flow freely between the inner surfaces of the crown plates and the flukes.

According to a first aspect of the invention, the second end of the shank defines opposite end surfaces adapted for engagement upon respective opposed inner surfaces of the crown plates thereby to limit the range of pivoting movement of the flukes.

In preferred embodiments of this aspect of the invention, at least one of the opposite end surface of the shank is adapted to engage an opposed inner surface of the crown plate along a line of contact whereby holding load is transferred from the shank to the flukes by means of a long coupled reaction.

According to another aspect of the invention, a pair of fluke elements each comprises a fluke and rib, and further comprises an integral bracket extension, and the crown plates are mounted upon the integral bracket extensions.

According to still another embodiment, an anchor of the invention includes a combination of the features described above.

In preferred embodiments of the twin fluke anchor of any of the described aspects of the invention, the ratio of the width of the fluke in the region of stock to the perpendicular height of the reinforcing rib in the same region is of the order of about 2:1.

Thus there is provided a twin fluke (or so-called "Danforth Standard") anchor of improved construction providing an extended length of useful life.

These and other features and advantages of the invention will be seen from the following description of a presently preferred embodiment, and from the claims.

DESCRIPTION OF A PRESENTLY PREFERRED EMBODIMENT

We first briefly describe the drawings.

FIG. 1 is a plan view of a prior art Danforth Standard or twin fluke anchor, while FIG. 1A is a side elevation of the prior art anchor showing details of construction of the crown;

FIG. 2 is a plan view of an improved twin fluke anchor of the invention, while

Figure 2:
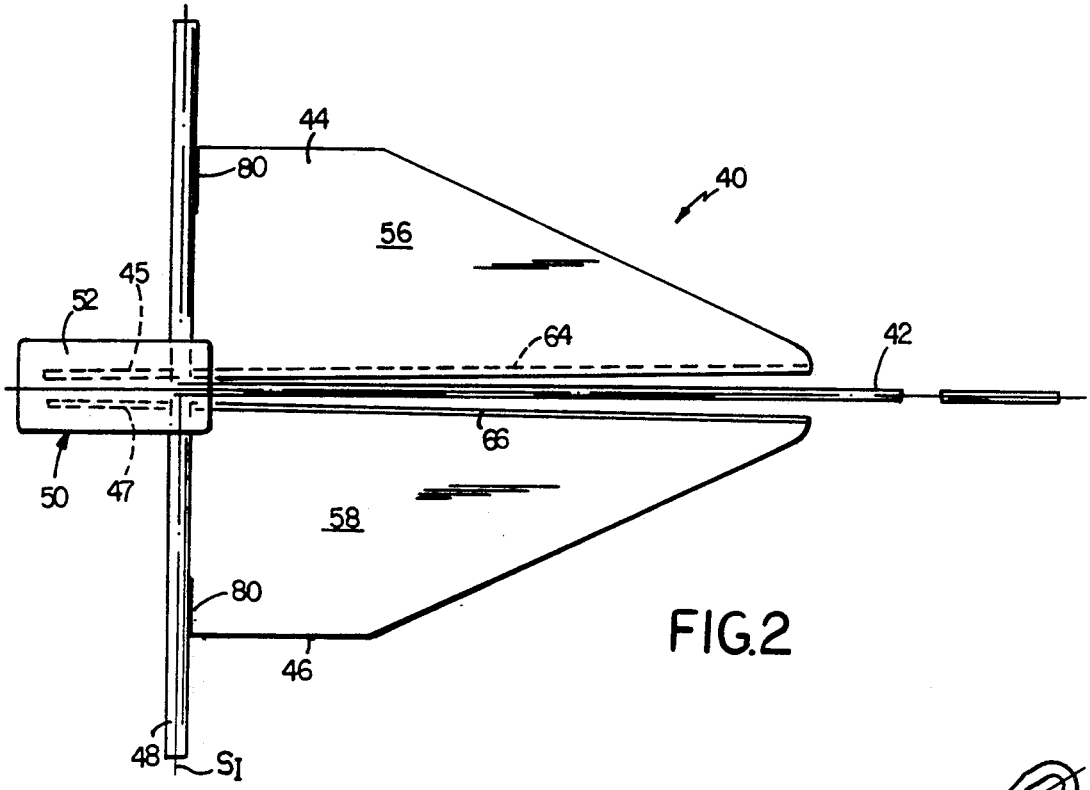

Referring to FIGS. 1 and 1A, a prior art Danforth Standard twin fluke anchor 10 is formed of a shank 12, flukes 14, 16 mounted on stock 18 and crown 20. The crown is formed of crown plates 22, 24 and bracket plates 26, 28, the bracket plates extending between the crown plates, generally perpendicular to the plane $P_D$ of the fluke surfaces 30, 32. The flukes, formed of steel or other suitable material, are bent at right angles along each inner edge 31, 33 to form reinforcing ribs 34, 36. The ribs are joined to bracket plates 26, 28 by welding at 27, 29. Referring also to FIG. 1A, the lower end 13 of the shank 12 is disposed between the bracket plates 26, 28. The crown plates are notched at 23, 25.

In operation, the flukes bury in homogeneous bottom conditions, with the extended area of the surfaces 30, 32 of the flukes 14, 16 developing a relatively large holding power against load exerted upon the shank !2, pivoting about the axis $S_D$ of the stock 18. The holding load is transferred from the shank 12 to the crown 20 during upwardly-directed tension drawn upon the shank, e.g. as occurs repeatedly when the boat or ship is riding at anchor and when the anchor is drawn from the bottom, only at a point of contact at the notch 23 or 25. The holding load is further transferred from the crown to the flukes, in part, by way of the welds 27, 29.

It has been observed (e.g. as reported in the May 1989 issue of *Cruising World*) that twin fluke anchors of this construction are susceptible to wear and deterioration of performance as a result of wear on the crown plates 22, 24 at the notches 23, 25 due to engagement of the shank, and as a result of failure of the welds 27, 29 of the ribs 34, 36 to the crown bracket plates 26, 28 due to force upon the flukes. The failure mode has included: shearing through the crown plate with a scissors-like action, tensile failure of the crown plate to crown bracket plate welds 37 due to this scissors-like action, and/or tensile failure of the fluke rib to crown bracket critical welds 27, 29.

Figure 2A:
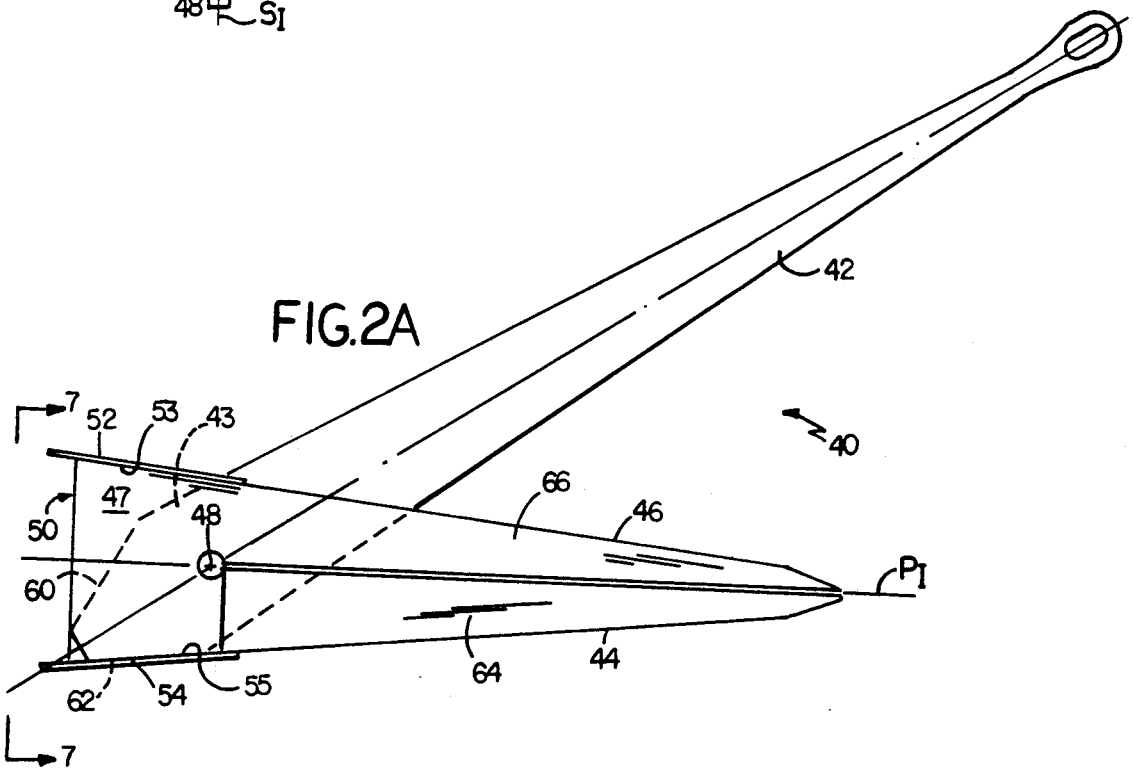
FIG. 2A is a side elevation of the improved anchor of FIG. 2 showing details of construction of the crown of that anchor.

According to the invention, an improved anchor of the Danforth Standard or twin fluke design has reduced occurrence of failure. Referring now to FIG. 2 et seq., the improved anchor 40 of the invention includes a shank 42 with twin flukes 44, 46 mounted on stock 48 for pivoting movement about stock axis $S_I$ at the lower end 43 of the shank. A crown 50 is formed of two crown plates 52, 54 disposed on both sides of the fluke pivot and mounted centrally of the flukes, the crown plates spaced from the plane $P_I$ of the fluke surfaces 56, 58. Each crown plate 52, 54 slopes upwardly and rearwardly away from plane $P_I$ in manner previously known, to permit bottom matter to flow freely between the flukes and the inner surfaces 53, 55 of the crown plates. Referring to FIG. 2A, the inner end 43 of the shank extends beyond the stock 48 to define a pair of opposite shank second or inner end surfaces 60, 62 disposed to engage upon the opposed inner surfaces 53, 55 of the crown plates to limit pivoting movement of the shank 42 about axis $S_I$ of the shank, the engagement of the respective shank end surfaces upon the opposed inner crown plate surface serving to distribute the holding load from the shank to the flukes by means of a long coupled reaction along the line of contact, thus avoiding the focused point contact of prior art anchors and the resultant scissors-like shearing failure. This relationship tends to reduce the load from that experienced in prior art anchors of similar construction and holding load rating by a factor of about three, and distributes the load over a greater area of the crown plate and over the lengths of the crown plate to bracket extension welds.

Figure 3:
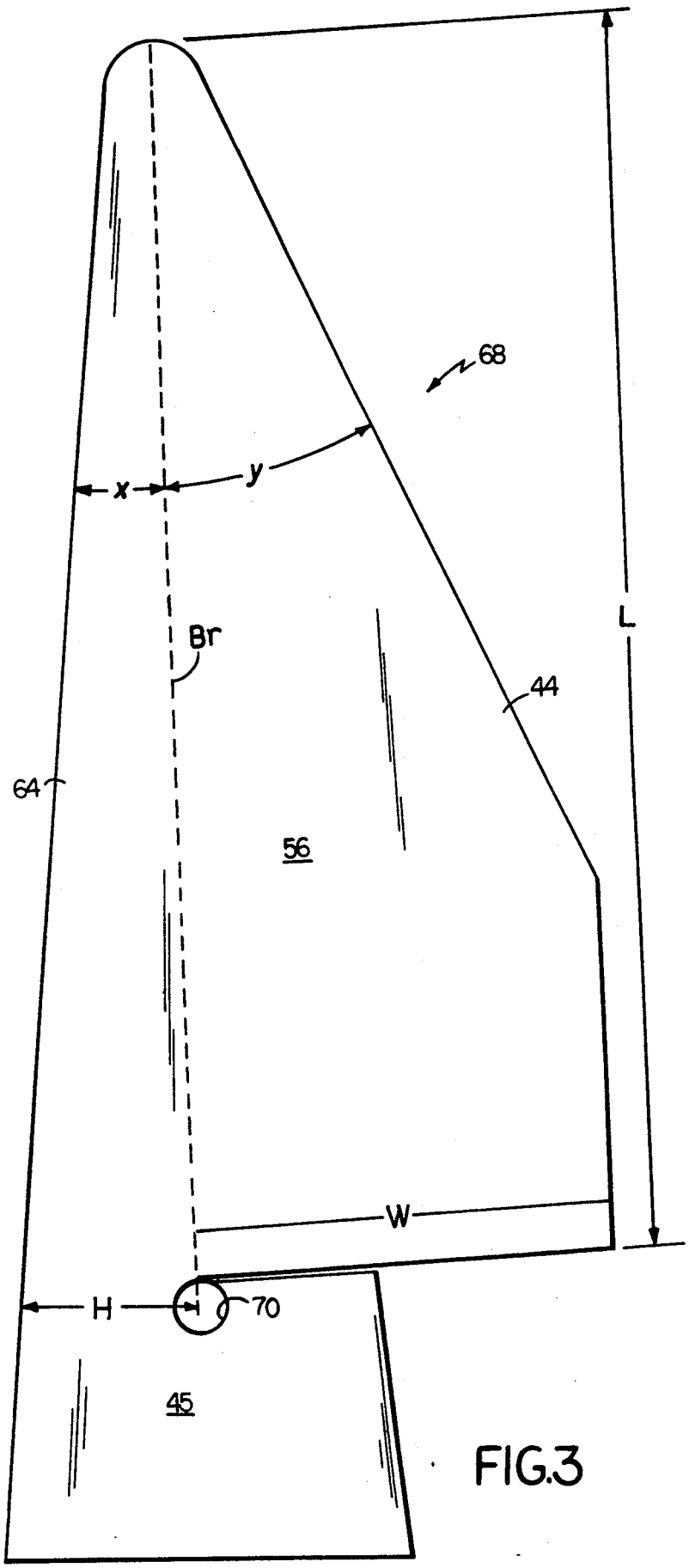
FIG. 3 is a plan view of a plate for forming a fluke element of the improved anchor of FIG. 2, including the fluke, rib and bracket extension, prior to formation of the anchor.

The crown bracket regions 45, 47 of the anchor 40 of the invention are integral extensions of fluke elements 68 from which the respective flukes 44, 46 and reinforcing ribs 64, 66 are also formed. Referring to FIG. 3, fluke element 68 is formed from metal plate stock, e.g. AISI 4130 steel hardened and tempered to $R_C$40/43, of suitable thickness, e.g. 10 gauge (0.1345 inch) for a Model 2500 anchor designed to provide 2,500 pounds nominal holding power, a typical anchor. (Dimensions and materials for the Model 2500 anchor are provided here and below for the purpose of example only; the requirements for anchors of other size and/or holding power will be apparent to those skilled in the art.) The fluke segment includes fluke 44 (defining fluke surface 56), a reinforcing rib 64, and crown bracket region 45. A hole 70 is provided for through passage of the stock. To form the anchor 40 of the invention, the fluke 44 is bent along line Br (at angle X, about 6°, to the edge of the rib and at angle Y, about 24° to the edge of the fluke) to lie generally perpendicular to integral rib 64 and bracket region 45. In this manner, the critical fluke rib to crown bracket weld of the prior art anchor design is eliminated.

By way of example only, for a typical anchor of the invention, e.g. having nominal holding power of 2,500 pounds, the fluke has length L, e.g. about 16.375 inches, and width W in the region of the stock hole 70, e.g. 5.25 inches. The reinforcing rib 64 in the same region has height H, e.g. about 2.236 inches, proving a ratio of fluke width to reinforcing rib height (W:H) of the order of about 2 to 1, for improved fluke stiffness, e.g. an increase of about a factor of three over prior art Danforth Standard twin fluke anchors of comparable holding power.

Figure 4:
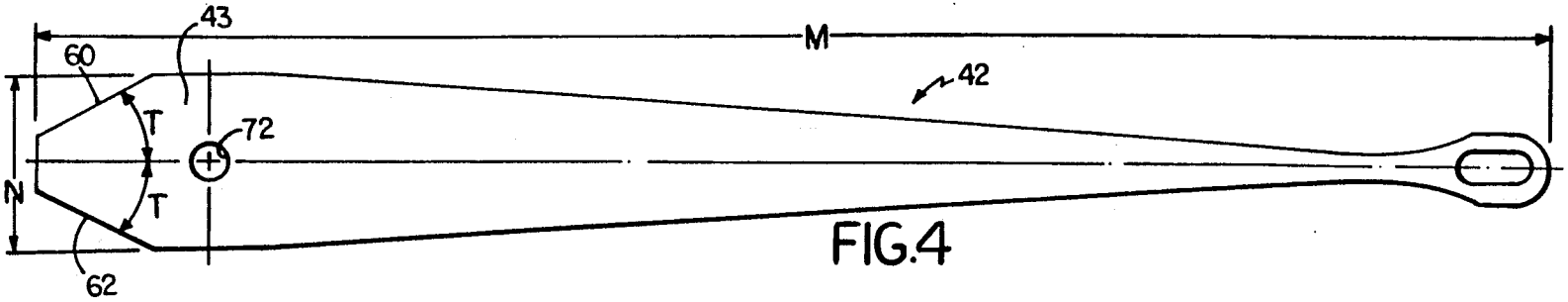
FIG. 4 is a plan view of the shank of the improved anchor of FIG. 2.

Referring to FIG. 4, shank 42 is formed of suitable material, e.g. AISI 4130 steel hardened and tempered to $R_C$40/43. For a typical anchor of the invention, e.g. the Model 2500 described above, the shank is about 3/16 inch thick, having length M, e.g. about 32 inches, and a maximum width N at inner end 43, e.g. about 3.75 inches. A shank hole 72 defined at the inner end 43 of the shank is sized to receive the stock in pivoting relation. As described above, shank end surfaces 60, 62 at the inner end of the shank, lying at angle T, e.g. about 27.5°, to the axis K of the shank 42, are disposed to engage upon the inner surfaces of the crown plates in a manner to distribute holding load drawn upon the shank.

Figure 5:
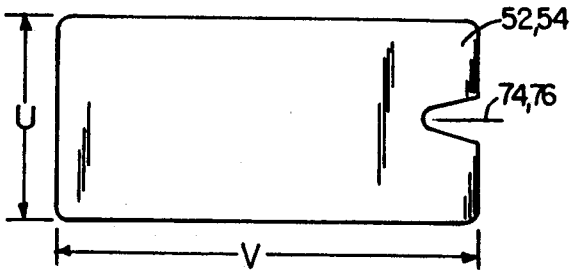
FIG. 5 is a plan view of the crown plate of the improved anchor of FIG. 2.

Referring to FIG. 5, crown plates 52, 54, e.g. formed of ASTM A36 steel, have width U and length V, e.g., for the Model 2500 anchor of the invention described above, about 2.5 by 5.25 inches, with a thickness of about 0.1793 inch (7 gauge). A notch 74, 76 is formed at one end of each of the crown plates.

Figure 6:
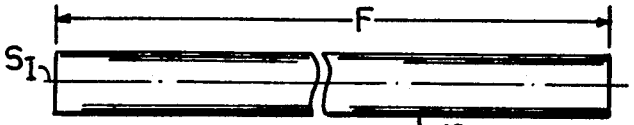
FIGS. 6 and 6A are plan and end views respectively of the stock of the improved anchor.
Figure 6A:
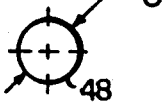

Referring to FIGS. 6 and 6A, the stock 48, e.g. formed of AISI 1040 full annealed steel, has length F and diameter G appropriate for the size of anchor, e.g. for a Model 2500 anchor of the invention, 19.5 inches long by 0.675 inch diameter.

Figure 7:
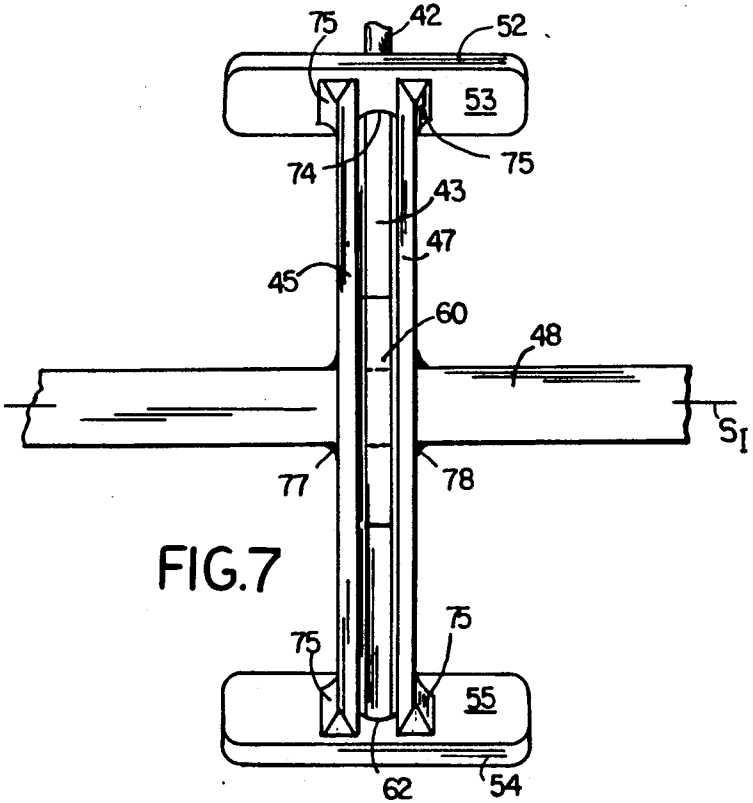
FIG. 7 is an end view of the improved anchor taken at the line 7—7 of FIG. 2A.

Referring again to FIGS. 2 and 2A, and now also to FIG. 7, the shank 42 and preformed fluke elements 68 are assembled on the stock 48 by placing the inner (second) end 43 of shank 42 between the crown bracket extensions 45, 47 of fluke elements 68, with fluke element stock holes 70 and shank hole 72 in alignment on axis $S_I$, and inserting the stock 48 through the aligned holes. The crown plates 52, 54 are welded (at 75) to the bracket extensions 45, 47 of the fluke elements 68. The stock is centered and then fixed in place by welding (at 77, 78) to the crown bracket extensions, with the shank free to pivot between positions of engagement of opposed crown plate and shank end surfaces 53, 60 and 55, 62. Assembly is completed by welding (at 80) the tips of the flukes 44, 46 to the stock 48.

Other embodiments of the anchor of the invention are within the following claims.

What is claimed is:

1. A twin-fluke anchor comprising:

a shank with a first end and a second end, a stock, a pair of fluke elements mounted upon said stock in a manner to pivot as a unit at the second end of the said shank, each said fluke element comprising a fluke defining a fluke surface disposed in a first plane, and a rib disposed generally perpendicular to said first plane and extending in one direction only from said fluke surface, said shank disposed between said ribs, and a crown comprising a pair of substantially flat crown plates, each said crown plate being supported centrally of said flukes in a position wherein said crown plate is spaced from said first plane of said flukes, each said crown plate sloping upwardly and rearwardly away from said first plane of said flukes in a manner to permit bottom material to flow freely between said inner surfaces of said crown plates and said flukes, each said fluke element further comprising an integral bracket extension, said crown plates being mounted upon said bracket integral extensions, and each said fluke element comprising an integral, jointless unit of said fluke, said rib and said bracket extension formed from a single sheet of stock material.

2. A twin-fluke anchor comprising:

a shank with a first end and a second end, a stock, a pair of fluke elements mounted upon said stock in a manner to pivot as a unit at the second end of the said shank, each said fluke element comprising a fluke defining a fluke surface disposed in a first plane, and a rib disposed generally perpendicular to said first plane and extending in one direction only from said fluke surface, said shank disposed between said ribs, and a crown comprising a pair of substantially flat crown plates having opposed inner surfaces, each said crown plate being supported centrally of said flukes in a position wherein said crown plate is spaced from said first plane of said flukes, each said crown plate sloping upwardly and rearwardly away from said first plane of said flukes in a manner to permit bottom material to flow freely between said inner surfaces of said crown plates and said flukes, said second end of said shank defining opposite end surfaces adapted for engagement upon said respective opposed inner surfaces of said crown plates thereby to limit the range of pivoting movement of said flukes, at least one said opposite end surface of said shank being adapted to engage said opposed inner surface of said crown plate along a line of contact whereby holding load is transferred from said shank to said flukes by means of a long coupled reaction, each said fluke element further comprising an integral bracket extension, said crown plates being mounted upon said bracket integral extensions, and each said fluke element comprising an integral, jointless unit of said fluke, said rib and said bracket extension formed from a single sheet of stock material.

3. The twin fluke anchor of claim 1 or 2 wherein the ratio of the width of each said fluke in the region of said stock to the perpendicular height of said reinforcing rib in the same region is of the order of about 2:1.

* * * * *